United States Patent [19]

Asaba et al.

[11] Patent Number: 4,958,580

[45] Date of Patent: Sep. 25, 1990

[54] SEWING MACHINE LATERAL FEED APPARATUS

[75] Inventors: Yutaka Asaba, Tokyo; Masaharu Chikamura, Kawasaki City, both of Japan

[73] Assignee: Juki Corporation, Tokyo, Japan

[21] Appl. No.: 303,535

[22] Filed: Jan. 27, 1989

[30] Foreign Application Priority Data

Jan. 29, 1988 [JP] Japan ..... 63-11799

[51] Int. Cl.[5] ..... D05B 27/02

[52] U.S. Cl. ..... 112/314; 112/323

[58] Field of Search ..... 112/314, 316, 323, 459, 112/463, 455

[56] References Cited

U.S. PATENT DOCUMENTS 4,226,199 10/1980 Adams ..... 112/323 X
4,428,316 1/1984 Patricia et al. ..... 112/323
4,633,796 1/1987 Hoffmann-Glewe et al. ..... 112/314

FOREIGN PATENT DOCUMENTS 2855958 7/1979 Fed. Rep. of Germany ..... 112/314
62-201182 9/1987 Japan .

*Primary Examiner*—Andrew M. Falik
*Attorney, Agent, or Firm*—Morgan & Finnegan

[57] ABSTRACT

A sewing machine including a laterally extending shaft with a cam contactor thereon being rocked by an eccentric cam assembly secured at a hook drive shaft provides an end face cam at its end such that a sliding shaft with a feed dog assembly thereon and contacting with the end face cam is slid laterally. Thereby, the feed dog is moved laterally, leftwardly or rightwardly, depending on the shifting of the cam contactor. The eccentric cam assembly comprises two eccentric cams configurated opposite in phase and formed such that leftward feed or rightward feed is selectively enabled, and a circular cam which causes no lateral feed. Shifting of the contactor to the selected cam is performed by a solenoid via a linkage system.

4 Claims, 2 Drawing Sheets

SEWING MACHINE LATERAL FEED APPARATUS

BACKGROUND OF THE INVENTION

This invention relates to sewing machines capable of stitching laterally and, more particularly, this invention relates to mechanisms for moving a sewing machine feed dog in a lateral direction.

As one example of a mechanism for moving a feed dog laterally, FIG. 2 is a drawing copied from Japanese laid open Pat. No. 62-201182, published on Sept. 4, 1987, and assigned to Juki Corporation, the same assignee as that of the present application.

Referring to FIG. 2, when a hook drive shaft 1 completes one rotation, an eccentric cam 2 causes an arm 3 to conduct one up-and-down motion. An end 3*a* of the arm 3 conducts one up-and-down motion and causes a shaft 4 to move up and down. A roller 5, pivoted to the end of shaft 4, also conducts one up-and-down motion and causes a feed bracket 6 to move up and down and resultantly a feed dog 7 moves up and down. Also, when shaft 1 completes one rotation, an eccentric cam 9 causes a bifurcated-arm 10 to move up and down.

A feed-adjusting motor 11 causes a forward-feed adjuster 12 to change its degree of inclination such that a slide block 13, slidably inserted in a groove 12*a*, causes the bifurcated arm 10 to move in a direction perpendicular to the shaft 1 and causes a shaft 14 to swing. Accordingly, the feed bracket 6 moves back and forth, the feed dog 7 feeds back and forth, and thus a work fabric placed on the feed dog 7 is fed forward.

When a lateral-feed-adjusting motor 15 rotates, a lateral mover 19 is slid laterally along a shaft 20 by a link 17 and a link arm 16. As the lateral mover 19 moves laterally, a contactor 21 located at the end of the lateral mover 19 contacts with a left-feed cam 22, with a straight-feed cam 23, or with a right-feed cam 24. The left-feed cam 22 and the right-feed cam 24 are eccentric cams and the straight-feed cam 23 is a circular cam. These cams are fixed to the shaft 1. When the contactor 21 contacts with the left-feed cam 22 or the right-feed cam 24, the eccentricity of these cams 22, 24 cause the lateral mover 19 to rock about the shaft 20.

A bifurcated plate 19*a* projected perpendicularly from the lateral mover 19 provides a slit 19*b* in which a shaft 25, projected perpendicularly from the shaft 20, is loosely inserted. The shaft 25 provides a roller cam 27 at its end. The roller cam 27 is in contact with a sloped surface 26*a* of a sloped surface cam 26. Thereby, as the lateral mover 19 rocks about the shaft 20, the roller cam 27 rolls on the sloped surface 26*a*. Since the sloped surface 26*a* is stationary, the shaft 20 is moved laterally.

Accordingly, a rotary arm 28 slidably mounted on the shaft 20 is moved laterally, by collars 20*b*, 20*c* fixed to the shaft 20 as shown in FIG. 2A, so that the feed bracket 6 with the feed dog 7 fixed thereon moves laterally. When the contactor 21 contacts with a circular cam 23, the lateral mover 19 does not rock, the shaft is not moved, and the workpiece is only fed straight. As shown in FIG. 2A, the end 20*a* of the shaft 20 is pressed by a plate spring PS such that the roller cam 27 always contacts the sloped surface cam 26.

According to the above example, as shown in FIG. 2, the shaft 20 extends from the sloped surface cam 26 to the plate spring PS, so that its total length is very long. Thereby, the problem of bending moments on, and deflection of, the shaft 20 is unavoidable. Additionally, such a long shaft is inconvenient so far as positioning of other mechanical parts is concerned.

SUMMARY OF THE INVENTION

With the foregoing in mind, it is an object of the present invention to ease lateral movement of the feed dog in a sewing machine and to provide a more stable mechanism for lateral movement of the feed dog in a sewing machine.

In accordance with the present invention, a slide shaft which slides laterally and simultaneously rocks is provided such that a feed dog connected to the slide shaft conducts vertical, straight, and lateral motion. Vertical and straight motion of the feed dog are transmitted by way of a conventional mechanical feeding structure. Lateral motion of the slide shaft is transmitted by an end face cam which rocks. A triple cam including a left-feed cam, a right-feed cam, and a straight-feed cam causes the rocking motion of the surface cam in association with a contactor projected from the end face cam shaft.

In the prior art, a long shaft receiving lateral motion from a sloped surface cam pushes a rotary arm which structurally supports a feed bracket having a feed dog thereon. Thus, lateral motion is transmitted. According to the present invention, lateral motion is transmitted not by a long shaft but by a cam contacting device located midway along the long shaft of the prior art. Thereby, smooth stable lateral motion is conducted.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DETAILED DESCRIPTION OF THE DRAWINGS

Figure 1:
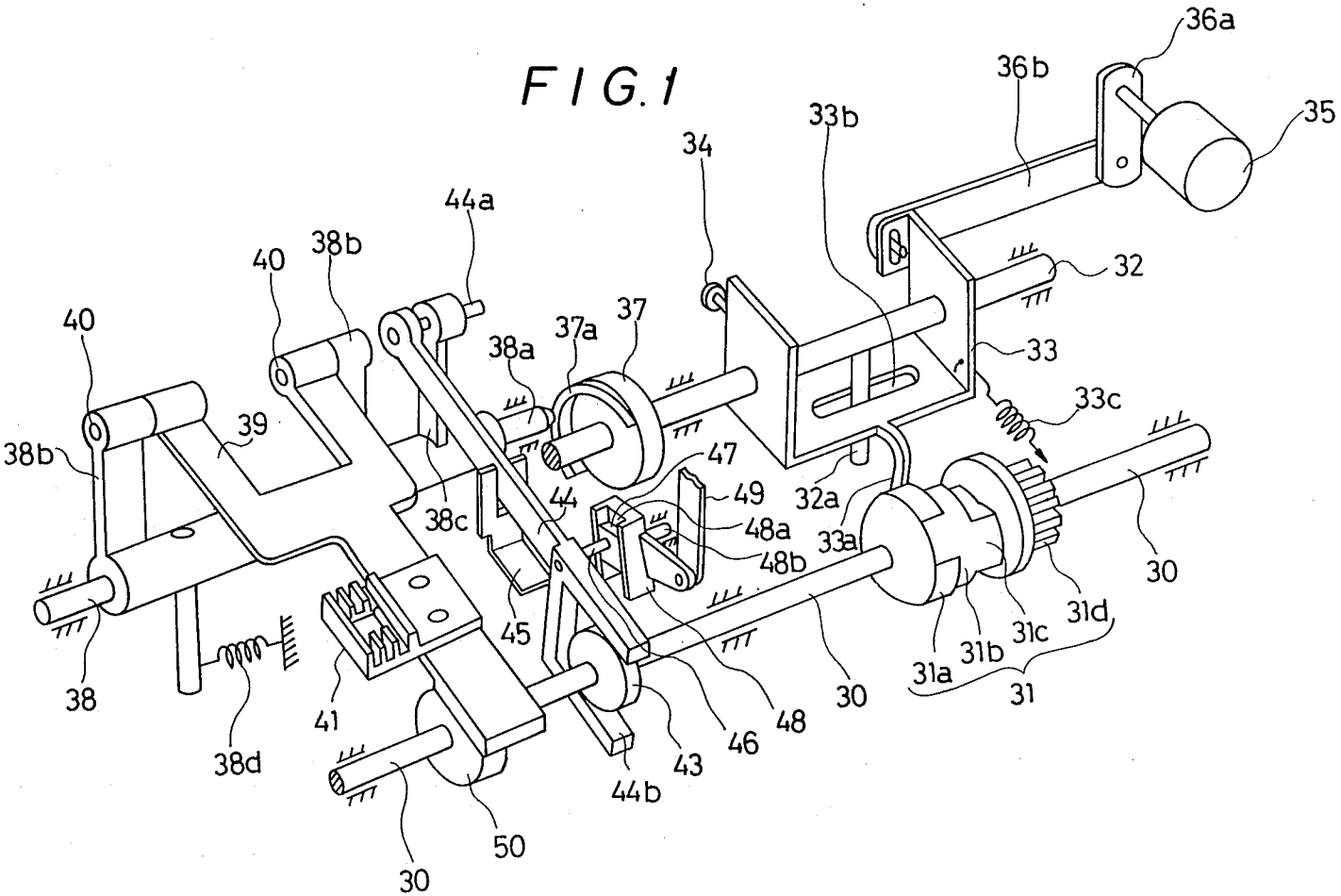
FIG. 1 is a perspective view of a feeding mechanism according to the present invention.

Referring to FIG. 1, one preferred embodiment of the present invention will be explained.

Numeral 31 denotes a triple cam fixed to a hook drive shaft 30. The hook drive shaft 30 drives a hook (not shown) indirectly. The triple cam comprises a left-feed cam 31*a*, a straight-feed cam 31*b*, and a right-feed cam 31*c*. Numeral 31*d* denotes a pulley driven by a timed belt (not shown) run by a main shaft (not shown). Numeral 32 denotes a contactor shaft rotatably supported by the machine frame. Numeral 33 denotes a bracket contactor slidably mounted on the contactor shaft 32.

A guide post 32*a* projected from the contactor shaft 32 is loosely inserted into an oblong hole 33*b* such that the bracket contactor 33 slides along the contactor shaft 32 laterally and the rocking motion of the bracket contactor 33 simultaneously causes the contactor shaft 32 to rock. The bracket contactor 33 is urged in contact with the triple cam 31 by way of a spring 33*c*.

Numeral 34 denotes an adjusting screw which adjusts the restored position of the bracket contactor 33. Numeral 35 denotes a stepping motor whose rotation causes the bracket contactor 33 to move laterally via links 36*a*, 36*b* such that the contact point between the contactor 33*a* and the triple cam 31 is shifted. Numeral 37 denotes an end-face-cam disc fixed to the end of the contactor shaft 32 and provides a cam surface 37*a*. Numeral 38 denotes a slide shaft whose end 38*a* is urged into contact with the cam surface 37*a* by a spring 38*d*. Numeral 39 denotes a feed bracket connected rotatably to arms 38*b* projected upwardly from the slide shaft 38 by two shafts 40. A feed dog 41 is attached on the feed bracket 39.

Numeral 43 denotes an eccentric cam for straight feeding and fixed to the hook drive shaft 30. Numeral 44 denotes a link for straight feeding and its one end is supported by a link arm 38*c* projected upward from the slide shaft 38. A shaft 44*a* is loosely inserted into the link 44 and the link arm 38*c*. Another end of the link 44 is bifurcated by channel-shaped frame 44*b* wherein the eccentric cam 43 contacts with both the upper and the lower sides of the channel shaped frame 44*b*.

Numeral 45 denotes a guide plate slidably supporting the middle portion of the link 44. Numeral 46 denotes a pin projected from the channel shaped frame 44*b* and its end provides rotatably a slide block 47. Numeral 48 denotes a feed adjuster and provides a channel-shaped groove 48*a* in which a slide block 47 is slidably inserted. The feed adjuster 48 provides a projected shaft 48*b* slidably sustained by the machine frame. A feed adjusting link 49, connected to the stepping motor (not shown), causes the channel shaped groove 48*a* to rotate about the projected shaft 48*b*. Numeral 50 denotes an eccentric cam fixed to the hook drive shaft 30. The eccentric cam 50 contacts with the end of the feed bracket 39 such that the feed bracket 39 is moved up down as the hook drive shaft 30 rotates.

Numerals from 43 to 45 are related members for moving the feed dog longitudinally, and numerals from 31 to 37 are related members for feeding the feed dog laterally.

In accordance with the above-described construction of the feed mechanism, how each mechanical part functions will be explained hereinafter.

When the main shaft (not shown) rotates, the hook drive shaft 30 rotates by pulley 31*d* run by the timing belt from the main shaft. If the contactor 33*a* is in contact with either the left-feed cam 31*a* or the right-feed cam 31*c*, the bracket contactor 33 rocks about the contactor shaft 32. Accordingly, the end face cam disc 37 rocks also. As the end face cam disc 37 rocks, the slide shaft 38 slides laterally, so the feed dog 41 attached on the feed bracket 39 moves laterally. As the hook-drive shaft 30 rotates, the eccentric cams 43, 50 rotate. When the eccentric cam rotates, the feed bracket 39 and the feed dog 41 move up and down. Rotation of the eccentric cam 43 causes the channel-shaped frame 44*b* to move up and down and consequently the slide block 47 slides along the channel shaped groove 48*a*. Accordingly, the end of the link 44 performs an elliptic motion and pushes the link arm 38*c* thereby causing the slide shaft 38 to rock. Thus, the resultant feeding direction of the feed dog 41 becomes forward aslant, and the workpiece is fed aslant.

As the difference of phase angle between the left feed cam 31*a* and the right feed cam 31*c* is 180 degrees, when the contactor 33*a* contacts with the left-feed cam 31*a*, the workpiece is fed left-forward and when the contactor 33*a* contacts with the right-feed cam 31*c* the workpiece is fed right-forward. Since the straight-feed cam 31*b* is not eccentric but circular, when the contactor 33*a* contacts with straight-feed cam 31*b*, the contactor-shaft 32 does not rock and the slide shaft 38 does not move laterally, so the workpiece is fed straight. Shifting of the contactor 33*a* is performed by the stepping motor 35 via links 36*a*, 36*b*.

According to the present invention, the slide shaft 38 is slid laterally by the end face cam disc 37 which rocks about the contactor shaft 32, and so the slide shaft 38 is smoothly slid laterally.

Figure 2:
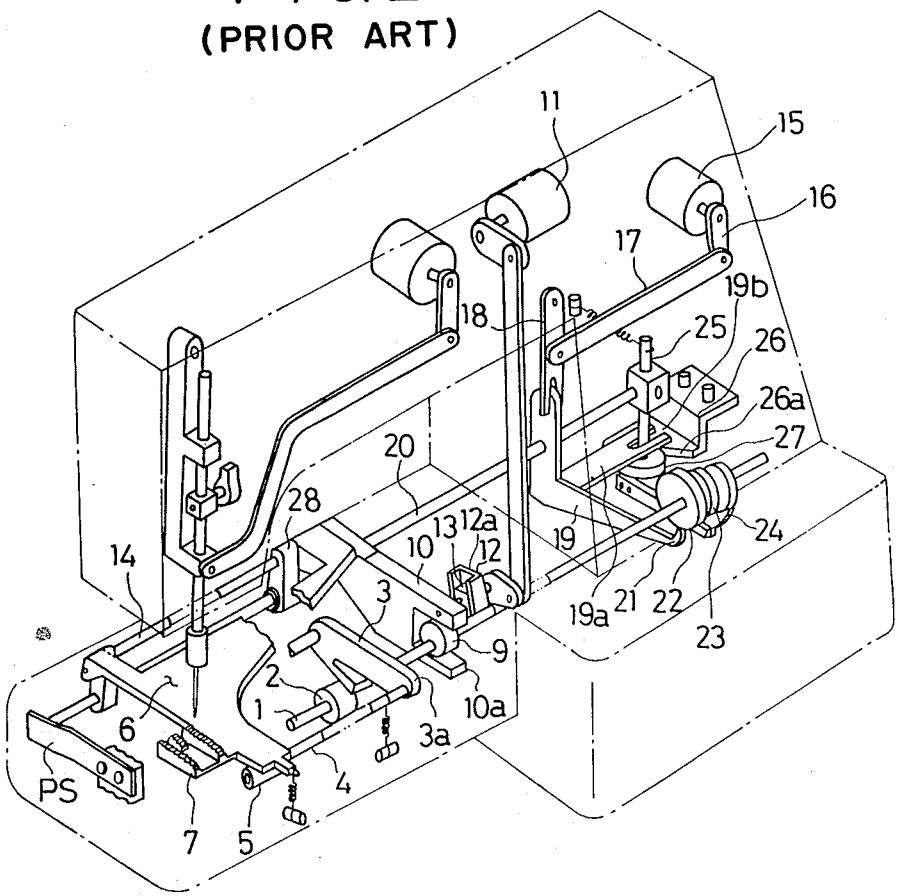
FIG. 2 (PRIOR ART)
FIG. 2 is a perspective view of a feeding mechanism according to the prior art.
Figure 2A:
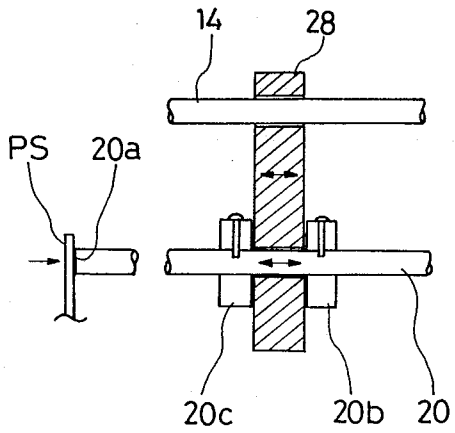
FIG. 2(A) (PRIOR ART)
FIG. 2A is a section view of the rotary arm shown in FIG. 2.

Accordingly to the prior art, referring to FIG. 2, the long shaft 20 pushes the rotary arm 28 to cause the lateral motion of the workpiece and, therefore, there exists the problem of bending of the shaft 20. Accordingly, it will be appreciated that the present invention is in many ways superior to the prior art. Additionally, according to the present invention, the contactor shaft 32 and the slide shaft 38 are shorter than the shaft 20 of the prior art and, thereby, design of the sewing machine is very much eased.

While the invention has been described in its preferred embodiment, it is to be understood that the words which have been used are words of description, rather than limitation, and changes may be made within the purview of the appended claims without departing from the true scope and spirit of the invention in its broader aspects.

What is claimed:

1. In a sewing machine, an apparatus for moving a feed dog in a lateral direction, comprising:

a frame;

a first shaft rotatably mounted on said frame to extend in said lateral direction;

a second shaft mounted on said frame to extend in said lateral direction;

a cam follower mounted on said first shaft;

cam means for rotating said cam follower about said first shaft;

means for transmitting rotation of said cam follower to said first shaft;

converting means including a face cam secured to said first shaft to engage with an end of said second shaft for converting rotation of said first shaft into axial movement of said second shaft;

a feed dog bracket rotatably mounted on said second shaft for mounting a feed dog thereon.

2. An apparatus for moving a feed dog of a sewing machine, comprising:

a frame;

a first shaft rotatably mounted on said frame to extend in a lateral directional;

a second shaft mounted on said frame to extend in said lateral direction;

a feed dog bracket rotatably mounted on said second shaft with a feed dog mounted thereon;

means for moving said feed dog between an upper position and a lower position;

a cam follower rotatably mounted on said first shaft;

a first cam for rotating clockwise said cam follower about said first shaft when said feed dog is positioned in said upper position;

a second cam for rotating counter-clockwise said cam follower about said first shaft when said feed dog is positioned in said lower position;

means for moving said cam follower along said first shaft between a first position in which said cam follower engages with said first cam and a second position in which said cam follower engages with said second cam;

means for transmitting a rotation of said cam follower to said first shaft; and a swash plate cam secured to said first shaft to engage with an end of said second shaft for converting rotation of said first shaft into linear movement of said second shaft in said lateral direction.

3. An apparatus according to claim 2 wherein said swash plate cam includes means for converting, the clockwise rotation of said first shaft into axial movement of said second shaft.

4. An apparatus according to claim 2 wherein said feed dog mounting comprises a third shaft extending in said lateral direction, a rod connected between said second shaft and said third shaft, and a feed dog bracket rotatably mounted on said third shaft to mount a feed dog thereon.

* * * * *